United States Patent [19]

Hinrichs et al.

[11] Patent Number: 4,818,965

[45] Date of Patent: Apr. 4, 1989

[54] ELECTROMAGNETIC RELAY

[75] Inventors: Fritz Hinrichs, Wolfratshausen; Herbert Mitschik, Geretsried, both of Fed. Rep. of Germany

[73] Assignee: Siemens Aktiengesellschaft, Berlin and Munich, Fed. Rep. of Germany

[21] Appl. No.: 55,497

[22] Filed: May 28, 1987

[30] Foreign Application Priority Data

Jun. 23, 1986 [DE] Fed. Rep. of Germany ..... 3620975

[51] Int. Cl.[4] ..... H01F 7/08; H01F 7/13

[52] U.S. Cl. ..... 335/274; 335/128; 335/276

[58] Field of Search ..... 335/274, 270, 276, 275, 335/128

[56] References Cited

U.S. PATENT DOCUMENTS

| | | | |
|---|---|---|---|
| 2,406,377 | 8/1946 | Immel | 335/274 |
| 2,913,548 | 11/1959 | Martin | 335/276 |
| 3,005,936 | 10/1961 | Bergmann | 335/274 |
| 3,201,541 | 8/1965 | Richert | 335/274 |
| 4,173,004 | 10/1979 | Woodlief | 335/236 |
| 4,338,585 | 7/1982 | Volke | 335/274 |

FOREIGN PATENT DOCUMENTS

| | | |
|---|---|---|
| 0027894 | 11/1981 | European Pat. Off. . |
| 242186 | 11/1910 | Fed. Rep. of Germany . |
| 859505 | 7/1949 | Fed. Rep. of Germany . |
| 1029330 | 5/1966 | United Kingdom . |

OTHER PUBLICATIONS

German Gebrauchonuster, G82 35 283.6, 5—28—87.

*Primary Examiner*—H. Broome
*Attorney, Agent, or Firm*—John F. Moran

[57] ABSTRACT

In a relay including an angle yoke (5), a flat armature (8) and a thin base plate (6) applied to the outside of the yoke, which forms a bearing groove (7) for the armature (8) together with the rectangularly cut end face (5*a*) of the yoke. The armature is pushed into the bearing groove by a predetermined particularly shaped bearing spring (15) and acted upon by a reset rotational moment. Through this arrangement, a space saving and cost-efficient construction of the relay with constant armature bearing force is obtained as well as low response efficiency.

32 Claims, 3 Drawing Sheets

ELECTROMAGNETIC RELAY

BACKGROUND OF THE INVENTION

This invention relates to electromagnetic relays of the type employing a core arranged in a coil and a yoke coupled to the core that at least partially extends beyond the coil to form an end face at its free end aligned essentially with a core pole face while forming a right angle with the axis of the coil. The invention, more particularly, relates to this type of relay wherein a flat armature is spring mounted on the end face of the yoke and forms with the core pole face a working air gap.

In a typical conventional relay of this kind, such as is described in the German patent document No. DE-GM 82 35 283, a plate-shaped armature is held by a bearing spring in front of the end face of the yoke, with the bearing spring itself being fastened on a yoke section relatively far removed from the end face, encompassing the entire bearing site arc-shaped and in its further course being firmly connected to the armature itself. The armature projects with its border edge beyond the outside of the yoke and has in the region of the bearing spring a cutout. With this kind of mounting, the armature does not have a definite roll-off site which can cause non-uniform flux transition. Furthermore, the bearing force is non-uniform.

In order to obtain with relays of this nature a defined bearing site, it is a conventional practice to bend the armature at an angle and let it roll off on a yoke knife-edge. This, practice, however, requires a relatively expensive adjustment step forth yoke and armature. Moreover, using an angle armature is possible only if sufficient space is available on the outside of the yoke for the projecting armature. One of the goals in miniaturizing relays is, however, to avoid such projecting movable parts for the sake of compactness of construction.

SUMMARY OF THE INVENTION

An object of the present invention is to provide a relay of the foregoing type having a defined mounting for the armature with good magnetic flux transition as uniform as possible, as well as a constant armature bearing force during operation, in a manner featuring an attendant significant reduction of expensive finishing processes for the individual components of the bearing.

In accordance with the invention an arrangement includes fastening on the surface of the free yoke end facing away from the coil an armature base plate of considerably lesser thickness than that of the yoke. The base plate projects beyond the yoke end and forms together with the end face of the yoke a bearing groove for the armature wherein the angle of aperture is greater than the angle of the edge of the armature bearing edge sitting in it, and a bearing spring pushes the armature into this bearing groove.

With a relay configuration according to the invention, a defined knife-edge bearing for the armature is created in a simple manner by a lamination applied on the outside of the yoke, so that neither the yoke nor the armature require being bent in a predetermined way or stamped. In the pulled-up state, the armature lies fully on the end face of the yoke cut at right angle, while in the dropped state a defined flux transition is achieved over the knife-edge bearing. In order to improve flux transition, the base plate is appropriately produced of ferromagnetic metal. Besides, the base plate only needs to have a fraction of the thickness of the yoke, for example of the order of magnitude of 5 to 25%, preferentially between 10 and 15%. In this manner, the external dimension of the magnetic system is increased to only an insignificantly extent by the additionally applied base plate. It is possible to provide a correspondingly small recess in the housing enclosing the yoke and the coil. The only requirement is that the base plate has to be connected with the yoke up to the latters border edge respectively has to rest on it, in order to form the previously mentioned bearing groove in a defined way. Fastening may take place through welding or a similar process or by mounting on laterally affixed catch elements. In so far as a welding point is within a certain distance from the end edge of the yoke, the entire magnetic system may additionally be secured through plug-in fastening within a housing, so that the base plate is not bent toward the outside by the end edge of the yoke.

In a first illustrative embodiment of the invention, the angle of aperture of the bearing groove is 90° with the base plate projecting beyond the yoke end as a planar lamination. In tis case, the armature is cut somewhat obliquely at its mounted end face, so that a bearing knife-edge having an acute angle is formed. Potentially, however, the base plate may be slightly bent toward the inside or outside at the yoke edge. Being bent inward establishes the bearing groove with an acute angle of aperture, so that the armature has to be cut with an even smaller angle. In this case, the armature is pushed by a spring force in its bearing plane into the bearing groove, so that potentially a simpler construction of the bearing spring is possible. In this case the function of the bearing spring may, for example, be in the form of a contact spring.

If, on the other hand, the base plate is bent slightly outward at the yoke edge, so that the bearing groove forms an obtuse angle, then this has the advantage that the armature may have a rectangular bearing knife-edge. In this case, production would be simpler. In addition, the base plate may, in any case, have lateral guide lugs for the armature.

The bearing spring, which pushes the armature into the bearing groove and in this way ensures uniformity of bearing force and a precisely defined flux transition, may be shaped in various ways. It is suitably arranged so that it does not only push the armature in the direction of the bearing knife-edge into the groove, but simultaneously does exert a rotational moment in the sense of an armature reset, in individual cases in the pull-up direction of the armature. In one illustrative embodiment it may be fashioned as a tension spring, which acts on the side of the armature facing away from the pole face and is fastened in the area of the free end of the base plate. The base plate itself may in this case form the inset loop; it would, however, be equally possible to provide additional means for fastening the spring. For practical purposes the spring has in its direction of tension a low spring constant, while having a large constant in the direction parallel to the bearing axis of the armature and the manner of fastening the spring solely permits a rotating movement around an axis parallel to the bearing axis of the armature. In this way, the armature is pushed into the bearing with a soft spring characteristic and reset, while being protected, on the other hand, against lateral migration in the direction of its axis. A tension spring of this nature can, for example, be bent, meander-shaped wire.

In another practical illustrative embodiment of the invention, the bearing spring is in the form of a leaf spring, which is fastened at one end of the extension region of the base plate and whose other end extends into one groove of the armature. It can be connected with the base plate and be fastened to it by being welded on or in a similar way. It is particularly advantageous, however, to form the base plate of a resilient material and to attach the bearing spring in one piece to this base plate. In this connection, the bearing spring may, for example, be bent in the shape of a hairpin. In order to generate soft spring characteristics in both angular directions of the bearing groove and simultaneously use as little space in the area in front of the armature, the bearing spring may have a first spring section arranged in the extension of the bearing plate and running parallel to the base plate, as well as a second spring section running essentially parallel to the armature, with the second spring section secured in the previously mentioned groove of the armature. Both spring sections may again be bent in the shape of hairpins. The bearing spring can, however, also be formed by two sections of the leaf spring lying adjacent to each other, which are attached to each other at the ends removed from the armature respectively from the base plate and are bent open forming an acute angle with respect to each other. In all these cases, the primary consideration is t exert through the shape of the bearing spring as soft a spring characteristic as possible on the armature, simultaneously, however, occupying as little space as possible for the bearing spring with respect to compactness of relay structure, in order to be able to utilize the area, which is available in front of the armature, for contact elements to be activated by the armature. If the bearing spring is affixed to the base plate in the most recently described manner, or fastened in another way independent of the armature, the mass of the armature is not increased by the spring being welded on. In this way, additional possibilities result in favorably controlling the chattering of the armature, i.e. to prevent bouncing to a large extent.

BRIEF DESCRIPTION OF THE DRAWING

Features of the invention and additional objects of the invention will be more readily appreciated and better understood by reference to the following detailed description which should be considered in conjunction with the drawing.

DETAILED DESCRIPTION

Figure 1:
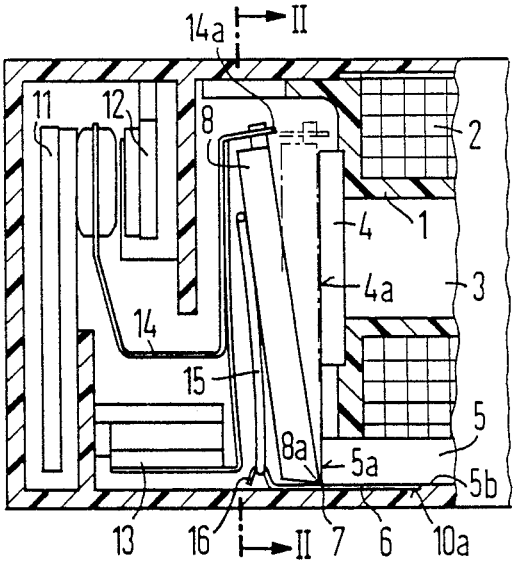
FIG. 1 and 2 illustrate an illustrative embodiment of a relay configured according to the invention in a partially exposed longitudinal section and an end face sectional view of the armature.
Figure 2:
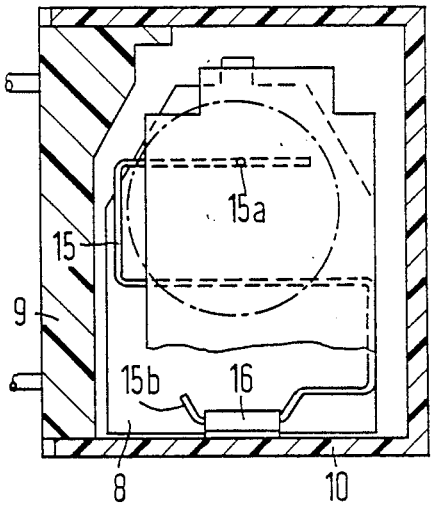

In FIGS. 1 and 2, a relay has a coil body 1 wind winding 2, in which a core 3 with a pole plate 4 is located. The opposite end of the core is hidden. It is coupled in the customary manner to an angular yoke, from which one arm 5 runs parallel to the coil axis next to the winding and forms with its free end a rectangularly cut end face 5*a*, which is aligned with the pole face 4*a* of the pole plate 4. On the outside 5*b* of the yoke arm 5 facing away from the coil, a base plate 6 is welded on, which is considerably less thick than the yoke and projects as planar lamination beyond the end face 5*a*, so that between the end face 5*a* and the base plate 6 a bearing groove is formed with an angle of 90°.

In the bearing groove 7 of FIG. 1 rests an armature 8, which forms at its mounted end a bearing knife-edge 8a with an angle of less than 90°, so that for switching it can be rotated in the bearing groove 7. The armature 8 is shown in resting position and indicated also in working position. The angle of its bearing edge is such, that the armature in the pulled-up state rests with its lateral surface on the end face 5*a* of the yoke and in its resting position with its end face on the base plate 6. In this way, in each position good flux transition is given, since additionally the base plate is expediently made of ferromagnetic material.

The entire magnetic system is situated within a housing including a pedestal 9 and a housing cap 10, with the coil body 1 together with the yoke arm 5 occupying the entire width of the base plate 6. Only the small thickness of the base plate 6 slightly exceeds this width of the magnetic system. For this, a recess 10a corresponding to the thickness of the base plate is provided in the housing cap 10. The base plate is additionally pushed on the yoke arm 5 by the housing cap, so that the base plate cannot move away from the border edge of the yoke arm 5, this means that the shape of the bearing groove 7 cannot be altered. In the pedestal 9, two opposite contact elements 11 and 12 are additionally anchored as well as a connecting element 13 for a contact spring 14; this Y-shaped bent contact spring 14 is mounted by a process 14*a* at the armature 8, so that it is actuated on motion of the armature.

An important feature of the armature bearing is, however, an additional bearing and readjusting spring 15, which is of meander-shaped wire and pulls the armature into the bearing groove as well as exerts a resetting rotational moment on it. This bearing spring 15 is welded at its upper end 15a to the armature and at its lower end 15b fastened on a loop 16, which is affixed on a process of the base plate 6. The bearing spring, due to its meander shape has a high spring constant in the lateral direction, i.e. in the direction parallel to the bearing axis of the armature, in its longitudinal direction, i.e. in the direction between its two fastening points, however, a soft spring characteristic, so that the armature is pushed into the bearing with little effort; in this way, the response efficiency of the relay is kept as low as possible. The mounting of the spring end 15b in the loop 16 is fashioned in such a way, that the spring can rotate around its inset axis, however, does not permit displacement in the direction of this axis. The armature is thus protected against movements in the direction of its axis.

Figure 3:
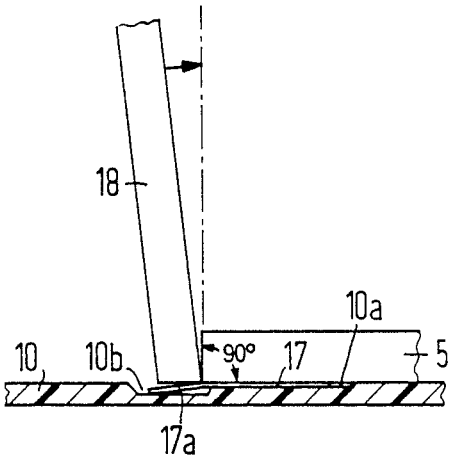
FIGS. 3 and 4 demonstrate two areas of the armature bearing with differently shaped base plates.

FIG. 3 provides a detailed aspect of a relay according to FIG. 1, in which the bearing, however, is slightly modified. On the yoke arm 5, a base plate 17 is affixed, the free end 17*a* of which is bent outward at the yoke endge, so that a bearing groove results, the angle of aperture of which between the base plate 17 respectively its end section 17*a* on the one hand, and the end face 5a of the yoke is greater than 90°. In this case, the armature 18 can have a bearing edge with an angle of less than 90°. It, thus, can be cut rectangularly, which simplifies its production. In order to receive the angled section 17*a* of the base plate, the housing cap 10 has a corresponding depression 10*b*.

Figure 4:
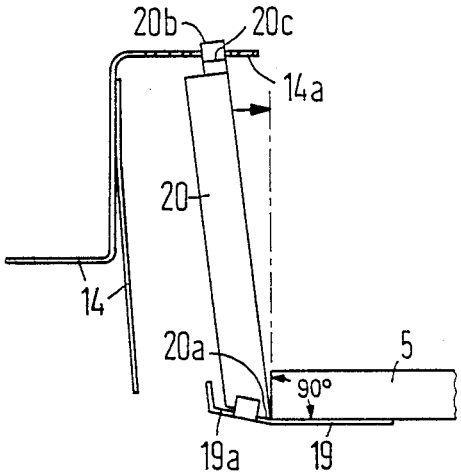

In FIG. 4, a further modification is shown in the detailed illustration of the armature bearing. On the yoke arm 5, in this case, a base plate 19 is fastened, the end section 19*a* of which is bent toward the armature so that a groove results with an angle of less than 90°. The armature 20 in this case must have a bearing knife-edge 20*a*, the angle of which is smaller yet than the angle of the bearing groove. This has the advantage that the bearing spring for the armature can be designed more simply. For, with a spring force, which acts on the armature 20 in its longitudinal direction, it is pushed by the actue angle of the bearing groove naturally into the latter. In this case, the contact spring 14 can serve as bearing spring, which is mounted by a spring lug 14*a* on a carrier tooth 20*b* of the armature and comes to rest on a shoulder 20*c*. In order to prevent the armature from migrating laterally in the axis direction, the base plate 19 has in addition guide lugs affixed laterally.

Figure 5:
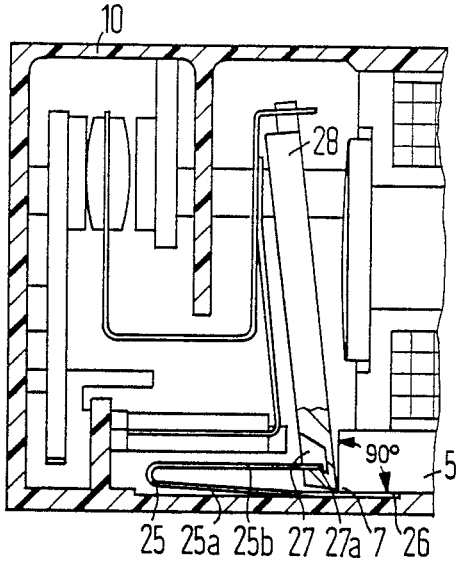
FIGS. 5 and 6 depict two further embodiments in a partial sectional view of the armature area with differently shaped bearing springs.

A further modification of the armature bearing is shown in FIG. 5 for a relay according to FIG. 1. Therein a hairpin-shaped bearing spring 25 is integrally formed with a bearing plate 26 and fastened at the yoke shank 5. The first shank 25*a* of the bearing spring extends in the extension of the bearing plate 26, while the second shank 25*b* engages with the free end a slot 27 of the armature 28. The underside 27*a* of this slot 27 is arched so that the bearing spring 25 pushes the armature into a bearing edge 7 and simultaneously exerts a reset moment on it. For the remainder the relay is constructed in a manner similar to that shown in FIG. 1.

Figure 6:
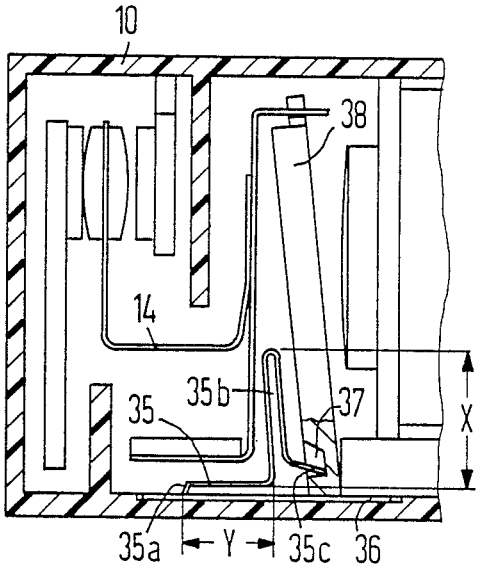

In FIG. 6 a still further modification of the armature bearing is shown suitable for a relay as shown in FIG. 1. In it, a hairpin-shaped base plate 35 is formed in oen piece with a base plate 36. The bearing spring 35 has two sections, essentially perpendicular to each other, namely section 35*a* as extension of the base plate and section 35*b* parallel to the armature. The free end 35*c* of the bearing spring 35 engages a groove 37 of the armature and pushes it in both axial directions into the bearing groove. The spring section 35*a* is formed by folding and bending at an angle, while section 35*b* is bent like a hairpin. Through the particular shaping and the amount of great spring involved, a small spring constant is obtained for the two axes and a nearly constant armature bearing force results. The area marked X of the spring section 35*b* thus results in a soft spring characteristic for the armature path in the direction of the coil axis, while the area marked Y of the spring section 35*a* causes soft spring characteristics for the armature path direction perpendicular to it. Depending on the magnitude of the bearing force, respectively the space requirement, varying the spring width in the X-area as well as in the Y-area is possible. Due to the specific shape of the bearing spring 35 in FIG. 6, one obtains the desired soft spring characteristic within the smallest space requirement, so that practically the entire area before the armature is available for forming the contact unit, in particular for achieving a great spring length for the contact spring 14.

Figure 7:
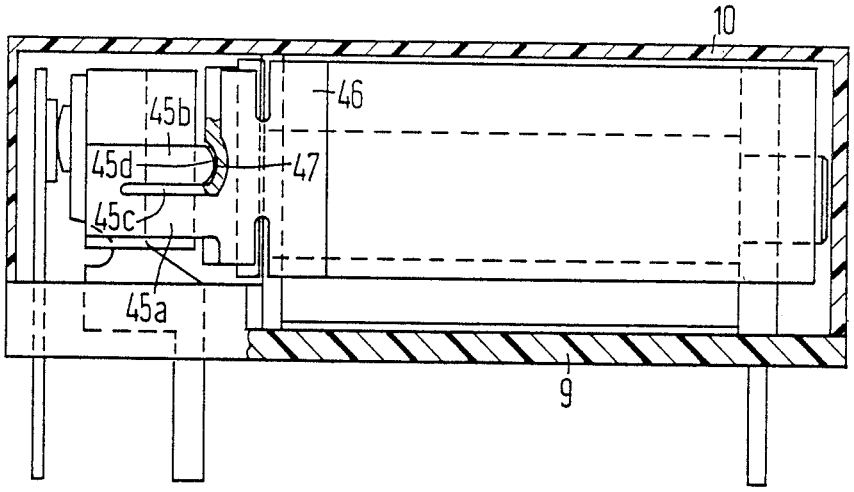
FIGS. 7 and 8 illustrate a further design version of the bearing spring in two different views.
Figure 8:
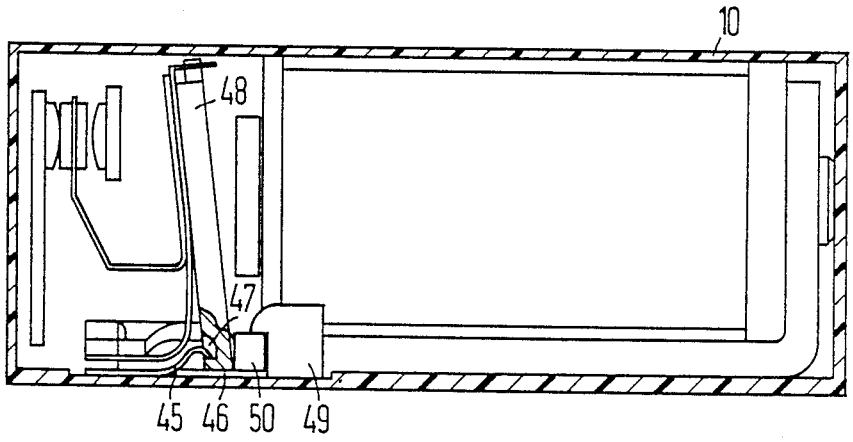

FIGS. 7 and 8 provide two views of the relay from FIG. 1 with a further modification of the bearing spring. In this case, too, the bearing spring 45 is of one piece with the base plate 46, which is fastened on the yoke arm 5. The bearing spring 45 is formed by two spring arms 45*a* and 45*b* lying next to each other, separated from each other by a slot 45*c*. Instead of just the two spring arms, further spring arms connected in meander-shaped fashion may be utilized in a further development (not shown). The free end 45*d* of the spring arm 45*b* reaches, as in the previous examples, into a groove 47 of the armature 48 in order to push it into the bearing an exert a resetting force on it. By rounding off the spring end 45*d*, on the one hand, and the groove 47 in the transverse direction, on the other hand, and through a corresponding rounding off of the armature groove 47, a centering effect is simultaneously exerted on the armature.

As illustrated in FIGS. 7 and 8, the base plates are fastened with laterally attached catch lugs 49 on corresponding projections 50 of the yoke arm 5.

There has thus been shown and described novel relay configurations which fulfill all the objects and advantages sought therefor. Many changes, modifications, variations and other uses and applications of the subject invention will, however, become apparent to those skilled in the art after considering this specification and the accompanying drawing which disclose the preferred embodiments therefore. All such changes, further modifications, variations and other uses and applications which do not depart from the spirit and scope of the invention are deemed to be covered by the invention which is limited only by the claims which follow.

What is claimed is:

1. An electromagnetic relay comprising:

a coil and a core arranged in the coil;

a yoke coupled with the core and extending at least partially adjacent to the coil and having a free end forming an end face essentially aligned with a core pole face cut at right angle to the coil axis; and a flat armature mounted on the end face of the yoke and forming with the core pole face a working air gap, the electromagnetic relay further comprising:

an armature base plate being of significantly lesser thickness than the yoke is fastened on a surface of the yoke facing away from the coil and projecting beyond the free end of the yoke, the armature base plate forming together with the end face of the yoke a bearing groove for the armature the bearing groove having an angle of aperture being greater than an edge angle of a bearing edge of the armature sitting in it; and a bearing spring pushing the armature into the bearing groove, the bearing spring being in the form of a leaf spring, which is fastened with one end in front of the free end of the base plate and with its other end extending into a groove of the armature.

2. An electromagnetic relay according to claim 1, wherein a housing part laterally encloses the coil and the yoke and has a recess corresponding to the thickness of the base plate.

3. An electromagnetic relay according to claim 1, wherein the bearing groove forms an acute angle and the bearing edge of the armature has a correspondingly smaller angle.

4. An electromagnetic relay according to claim 1, further comprising a housing part laterally enclosing the coil and the yoke and having a recess corresponding to the thickness of the base plate which lies therein.

5. An electromagnetic relay in accordance with claim 1, wherein the bearing spring has a first spring section essentially parallel to the base plate and a second spring section essentially parallel to the armature.

6. An electromagnetic relay according to claim 1, wherein the armature has a groove shaped in the form of a recess in a plane corresponding to the spring width and an end of the spring engages the groove and has a curvature serving as a centering element.

7. An electromagnetic relay according to claim 1, wherein the base plate comprises resilient material shaped in a single piece with the bearing spring.

8. An electromagnetic relay according to claim 3, wherein the armature has a groove shaped in the form of a recess in a plane corresponding to the plane of the spring width and an end of the spring engages the groove and has a curvature serving as a centering element.

9. An electromagnetic relay according to claim 6, wherein the armature has a groove shaped in the form of a recess in a plane corresponding to the plane of the spring width and an end of the spring engages the groove and has a curvature serving as a centering element.

10. An electromagnetic relay comprising:

a coil and a core arranged in the coil;

a yoke coupled with the core and extending at least partially adjacent to the coil and having a free and forming an end face essentially aligned with a core pole face cut at right angle to the coil axis; and a flat armature mounted on the end face of the yoke and forming with the core pole face a working air gap, the electromagnetic relay further comprising:

an armature base plate being of significantly lesser thickness than the yoke is fastened on a surface of the yoke facing away from the coil and projecting beyond the free end of the yoke, the armature base plate forming together with the end face of the yoke a bearing groove for the armature the bearing groove having an angle of aperture being greater than an edge angle of a bearing edge of the armature sitting in it; and a bearing spring pushing the armature into the bearing groove, the bearing spring having a first spring section essentially parallel to the base plate and a second spring section essentially parallel to the armature.

11. An electromagnetic relay according to claim 10, further comprising a housing part laterally enclosing the coil and the yoke and having a recess corresponding to the thickness of the base plate which lies therein 12. An electromagnetic relay according to claim 10, further comprising a housing part laterally enclosing the coil and the yoke and having a recess corresponding to the thickness of the base plate which lies therein.

13. An electromagnetic relay according to claim 10, wherein the tension spring is meander-shaped.

14. An electromagnetic relay according to claim 10, wherein the tension spring is mounted in a loop affixed to the free end of the base plate.

15. An electromagnetic relay comprising:

a coil and a core arranged in the coil;

a yoke coupled with the core and extending at least partially adjacent to the coil and having a free end forming an end face essentially aligned with a core pole face cut at right angle to the coil axis; and a flat armature mounted on the end face of the yoke and forming with the core pole face a working air gap, the electromagnetic relay further comprising:

an armature base plate comprising ferromagnetic material being of significantly lesser thickness than the yoke is fastened on a surface of the yoke facing away from the coil and projecting beyond the free end of the yoke, the armature base plate forming together with the end face of the yoke a bearing groove for the armature the bearing groove having an angle of aperture being greater than an edge angle of a bearing edge of the armature sitting in it; and a bearing spring pushing the armature into the bearing groove, the bearing spring being a leaf spring which is fastened with one end in front of the free end of the base plate and with its other end extending into a groove in the armature.

16. An electromagnetic relay comprising:

a coil and a core arranged in the coil;

a yoke coupled with the core and extending at least partially adjacent to the coil and having a free end forming an end face essentially aligned with a core pole face cut at right angle to the coil axis; and a flat armature mounted on the end face of the yoke and forming with the core pole face a working air gap, the electromagnetic relay further comprising:

an armature base plate comprising ferromagnetic material being of significantly lesser thickness than the yoke is fastened on a surface of the yoke facing away from the coil and projecting beyond the free end of the yoke, the armature base plate forming together with the end face of the yoke a bearing groove for the armature the bearing groove having an angle of aperture being greater than an edge angle of a bearing edge of the armature sitting in it; and a bearing spring pushing the armature into the bearing groove, the bearing spring having a first spring section essentially parallel to the base plate and a second spring section essentially parallel to the armature.

17. An electromagnetic relay comprising:

a coil and a core arranged in the coil;

a yoke coupled with the core and extending at least partially adjacent to the coil and forming a free end forming an end face essentially aligned with a core pole face cut at right angle to the core axis; and a flat armature mounted on the end face of the yoke and forming with the core pole face a working air gap, the electromagnetic relay further comprising:

an armature base plate comprising ferromagnetic material being of significantly lesser thickness than the yoke is fastened on a surface of the yoke facing away from the coil and projecting beyond the free end of the yoke, the armature base plate forming together with the end face of the yoke a bearing groove for the armature the bearing groove having an angle of aperture being greater than an edge angle of a bearing edge of the armature sitting in it the angle of aperture of the bearing groove being 90° and the bearing edge of the armature having an acute angle; and a bearing spring pushing the armature into the bearing groove, the bearing spring being a leaf spring fastened with one end in front of the free end of the base plate and with its other end extending into a groove of the armature.

18. An electromagnetic relay according to claim 11, further comprising a housing part laterally enclosing he coil and the yoke and having a recess corresponding to the thickness of the base plate which lies therein.

19. An electromagnetic relay according to claim 11, wherein the bearing spring exerts on the armature simultaneously a reset rotational movement around a bearing axis.

20. An electromagnetic relay according to claim 11, wherein the bearing spring is a tension spring, which acts upon a side of the armature facing away from the pole face and is mounted in the region of the free end of the base plate.

21. An electromagnetic relay according to claim 20, wherein the tension spring has a smaller spring constant rate in the direction of tension and a higher spring constant in the direction parallel to the bearing axis of the armature and mounting of the spring permits solely a rotating movement around an axis parallel to the armature bearing axis.

22. An electromagnetic relay according to claim 20, wherein the tension spring is meander-shaped.

23. An electromangetic relay according to claim 20, wherein the tension spring is mounted in a loop affixed to the free end of the base plate.

24. An electromagnetic relay according to claim 22, wherein the tension spring is mounted in a loop affixed to the free end of the base plate.

25. An electromagnetic relay according to claim 22 wherein the bearing spring has two or more spring sections cut from a plane of a leaf spring.

26. An electromagnetic relay comprising:

a coil and a core arranged in the coil;

a yoke coupled with the core and extending at least partially adjacent to the coil and having a free and forming an end face essentially aligned with a core pole face cut at right angle to the coil axis; and a flat armature mounted on the end face of the yoke and forming with the core pole face a working air gap, the electromagnetic relay further comprising:

an armature base plate being of significantly lesser thickness than the yoke is fastened on a surface of the yoke facing away from the coil and projecting beyond the free end of the yoke, the armature base plate forming together with the end face of the yoke a bearing groove for the armature the bearing groove having an angle of aperture being greater than an edge angle of a bearing edge of the armature sitting in it the angle of aperture of the bearing groove being 90° and the bearing edge of the armature having an acute angle; and a bearing spring pushing the armature into the bearing groove, a leaf spring serves as the bearing spring, which is fastened with one end in front of the free end of the base plate and with its other end extending into a groove of the armature.

27. An electromagnetic relay according to claim 26, wherein a bearing spring exerts on the armature simultaneously a reset rotational movement around a bearing axis.

28. An electromagnetic relay comprising:

a coil and a core arranged in the coil;

a yoke coupled with the core and extending at least partially adjacent to the coil and having a free and forming an end face essentially aligned with a core pole face cut at right angle to the coil axis; and a flat armature mounted on the end face of the yoke and forming with the core pole face a working air gap, the electromagnetic relay further comprising:

an armature base plate being of significantly lesser thickness than the yoke is fastened on a surface of the yoke facing away from the coil and projecting beyond the free end of the yoke, the armature base plate forming together with the end face of the yoke a bearing groove for the armature the bearing groove having an angle of aperture being greater than an edge angle of a bearing edge of the armature sitting in it the angle of aperture of the bearing groove being 90° and the bearing edge of the armature having an acute angle; and a bearing spring pushing the armature into the bearing groove, a leaf spring serving as the bearing spring, which is fastened with one end in front of the free end of the base plate and with it other end reaches into a groove of the armature.

29. An electromagnetic relay according to claim 28, wherein the bearing spring is a tension spring, which acts upon a side of the armature facing away from the pole face and is mounted in the region of the free end of the base plate.

30. An electromagnetic relay comprising:

a coil and a core arranged in the coil;

a yoke coupled with the core and extending at least partially adjacent to the coil and having a free and forming an end face essentially aligned with a core pole face cut at right angle to the coil axis; and a flat armature mounted on the end face of the yoke and forming with the core pole face a working air gap, the electromagnetic relay further comprising:

an armature base plate being of significantly lesser thickness than the yoke is fastened on a surface of the yoke facing away from the coil and projecting beyond the free end of the yoke, the armature base plate forming together with the end face of the yoke a bearing groove for the armature the bearing groove having an angle of aperture being greater than an edge angle of a bearing edge of the armature sitting in it the angle of aperture of the bearing groove being 90° and the bearing edge of the armature having an acute angle; and a bearing spring pushing the armature into the bearing groove, the bearing spring having a first spring section essentially parallel to the base plate and a second spring section essentially parallel to the armature.

31. An electromagnetic relay comprising:

a coil having an axis and a core located axially in the coil, the core having a planar face oriented perpendicularly to the axis, a yoke coupled magnetically to the core and the yoke extending at least partially adjacent to the coil and having a free end forming an end face essentially aligned with the planar face; and a flat armature mounted on the end face of the yoke and forming with the planar face a working air gap, the electromagnetic relay further comprising:

an armature base plate being of significantly lesser thickness than the yoke is fastened on a surface of the yoke facing away from the coil and projecting beyond the free end of the yoke, the armature base plate forming together with the end face of the yoke a bearing groove for the armature the bearing groove having an angle of aperture being greater than an edge angle of a bearing edge of the armature sitting in it; and a bearing spring pushing the armature into the bearing groove, the bearing spring being a leaf spring having two ends, one end fastened to the yoke and the spring extending beyond the free end of the yoke and another end of the spring located in a groove in the armature located near the bearing groove, and the armature base plate comprising resilient material and being a section of the bearing spring.

32. A relay according to claim 31, further comprising a housing laterally enclosing the coil and the yoke and having a recess for accepting the base plate.

* * * * *